US010362411B2

(12) United States Patent
Riemer

(10) Patent No.: US 10,362,411 B2
(45) Date of Patent: Jul. 23, 2019

(54) HEARING DEVICE WITH FIXATION ARRANGEMENT

(71) Applicant: Oticon A/S, Smørum (DK)

(72) Inventor: Lars Riemer, Smørum (DK)

(73) Assignee: Oticon A/S, Smørum (DK)

( * ) Notice: Subject to any disclaimer, the term of this patent is extended or adjusted under 35 U.S.C. 154(b) by 0 days.

(21) Appl. No.: 15/703,199

(22) Filed: Sep. 13, 2017

(65) Prior Publication Data

US 2018/0077500 A1 Mar. 15, 2018

(30) Foreign Application Priority Data

Sep. 14, 2016 (EP) ..... 16188749

(51) Int. Cl.

| | |
|---|---|
| ***H04R 25/00*** | (2006.01) |
| ***H04R 25/02*** | (2006.01) |
| ***H04R 1/10*** | (2006.01) |

(52) U.S. Cl.

CPC ..... *H04R 25/02* (2013.01); *H04R 25/65* (2013.01); *H04R 1/105* (2013.01); *H04R 1/1041* (2013.01); *H04R 2225/021* (2013.01); *H04R 2225/61* (2013.01); *H04R 2225/63* (2013.01)

(58) Field of Classification Search

CPC .... H04R 1/1041; H04R 1/105; H04R 25/606; H04R 25/02; H04R 25/65; H04R 2225/021; H04R 2225/61; H04R 2225/63

See application file for complete search history.

(56) References Cited

U.S. PATENT DOCUMENTS

2009/0316941 A1* 12/2009 Lowmiller ..... H04R 25/65 381/324

FOREIGN PATENT DOCUMENTS

| | | | |
|---|---|---|---|
| EP | 1 585 367 | A2 | 10/2005 |
| EP | 1 585 367 | A3 | 10/2005 |
| JP | 2011-23974 | A | 2/2011 |
| WO | WO 2004/004416 | A1 | 1/2004 |
| WO | WO 2012/010195 | A1 | 1/2012 |

* cited by examiner

*Primary Examiner* — Sunita Joshi

(74) *Attorney, Agent, or Firm* — Birch, Stewart, Kolasch & Birch, LLP

(57) ABSTRACT

A hearing device comprising a housing configured to be arranged in the ear canal or behind the outer ear of a user, wherein an attachment arrangement is mechanically connected to the housing. The attachment arrangement comprises at least one first attachment part and at least one second attachment part, which is configured to be arranged relative to each other by means of one or more attraction members provided on each of said first and second attachment parts.

20 Claims, 5 Drawing Sheets

HEARING DEVICE WITH FIXATION ARRANGEMENT

FIELD

The present disclosure relates to a hearing device having a housing configured to be arranged in the ear canal or behind the outer ear of a user. The present disclosure more particularly relates to a hearing device having an attachment arrangement attached to the housing, wherein the attachment arrangement comprises a first attachment part and a second attachment part configured to be arranged at opposing sides of the pinna of the user.

BACKGROUND

For e-health hearing devices (including hearing aids), it is often desired to arrange sensor elements (e.g. electrodes) in contact with the wearer's skin. Especially for hearing aid as behind-the-ear (BTE) and receiver-in-the-ear (RITE) types, it is difficult to ensure attachment of the sensor elements with a sufficient pressure towards the skin in order to maintain skin contact.

The prior art suggests the use of adhesives. However, this solution is expensive over time, and can lead to allergy issues (allergic reactions). Other prior art solutions apply clamps or springs. These solutions are associated to several drawbacks as they are often difficult to handle and can pinch or abrade the skin. Additionally, a range of clamp sizes must be stocked and selected by the hearing care professional.

Therefore, there is a need to provide a solution that addresses at least some of the above-mentioned problems. The present disclosure provides at least an alternative to the prior art.

SUMMARY

According to an aspect of the disclosure, the hearing device is a hearing device, preferably a hearing aid, comprising a housing configured to be arranged in the ear canal or behind the outer ear of a user, wherein an attachment arrangement is connected to the housing. The attachment arrangement further comprises:

at least one first attachment part, and at least one second attachment part, wherein the first attachment part is configured to be arranged at the side of the pinna facing an opening of the ear canal of the user, wherein the second attachment part is configured to be arranged at the opposite side of the pinna than the first attachment part in such a manner that the first attachment part and the second attachment part of the attachment arrangement are fixed relative to each other by means of one or more attraction members provided on each of said first and second attachment parts, wherein the first and/or second attachment part comprises one or more sensor elements arranged to be brought into contact with a skin portion of the ear.

Hereby, it is possible to attach the sensor elements with a sufficient pressure towards the skin in order to maintain skin contact. Accordingly, the first attachment part and the second attachment part can be attached to opposing sides of the pinna. Thus, the disclosure provides a useful and suitable alternative to the prior art. The attraction members (e.g. magnets) is preferably configured to provide a sufficient pressure towards the skin.

It should be noted that the first and/or second attachment part is preferably not connected by any mechanical means, but are held in place in relation to other due to the attraction members. However, holding means, such as mechanical connections between the two attraction parts would be contemplated as an alternative or extra means for attachment between the first and second attachment part.

The hearing device comprising a housing configured to be arranged in the ear canal or behind the outer ear of a user. The housing may be a housing of an invisible-in-the-canal (IIC) hearing aid, a completely-in-canal (CIC) hearing aid, an in-the-canal (IC) hearing aid, a BTE hearing aid or a RITE hearing aid. The housing may have any suitable geometry and size.

The attachment arrangement may be connected (e.g. by a mechanical connection) to the housing and comprises at least one first attachment part and at least one second attachment part, wherein the first attachment part is configured to be arranged at the side of the pinna facing an opening of the ear canal of the user, wherein the second attachment part is configured to be arranged at the opposite side of the pinna than the first attachment part in such a manner that the first attachment part and the second attachment part of the attachment arrangement are fixed relative to each other by means of one or more attraction members provided on each of said first and second attachment parts.

The first attachment part and the second attachment part may have any suitable geometry and shape. The first attachment part and the second attachment part may comprise a contact structure adapted to fit the geometry of the pinna. Such contact structure may comprise a basically plate-shaped structure.

The attraction members may have any suitable size and geometry and they may be arranged in any suitable position of the first attachment part and the second attachment part.

In one embodiment according to the disclosure, the attraction members may be positioned at either the outer periphery of the first attachment part or the second attachment part.

The first and/or second attachment part comprises one or more sensor elements arranged to be brought into contact with a skin portion of the ear.

The sensor elements may comprise any suitable sensor technology and may be positioned in any suitable position on the first and/or second attachment part. The sensor elements may be electrodes or light sensors by way of example. Furthermore the sensors may function as both a receiving and transmitting element. That is the sensors may incorporate both transmitting and receiving components.

According to an embodiment, the second attachment part is attached to the housing or directly to the pinna of said ear, preferably by a mechanical attachment. The second attachment part comprising at least two attraction members, wherein the first attachment part comprises at least two attraction members, wherein at least two of the attraction members of the second attachment part are arranged with essentially the same distance to each other as at least two of the attraction members of the first attachment part.

Hereby, it is possible to arrange the attraction members in the most optimum position relative to each other. Accordingly, the highest attraction forces can be provided by the members.

In one embodiment of the disclosure, the attraction members of the first and second attachment part comprise magnetic or magnetisable material or an electrostatic material. Hereby, it is possible to provide the required attraction forces by simple means.

According to further aspect of the disclosure, the attraction members of the second attachment part are permanent magnets or other ferromagnetic members and/or said attraction members of the first attachment part are permanent magnets or other ferromagnetic members.

The use of permanent magnets or other ferromagnetic members provides a simple and efficient way of providing the requested attraction between the attraction members.

According to an embodiment of the disclosure, the attraction members of the first and second attachment parts being magnetic or magnetisable members of the attachment arrangement comprise one or more electromagnets.

Hereby, it is possibly to vary the magnetic field generated by the one or more electromagnets by activating and deactivating the one or more electromagnets. Accordingly, it is possibly to control and vary the attraction between the attraction members.

According to an embodiment, the magnetic or magnetisable members of the attachment arrangement comprise one or more electromagnets, wherein a number of electrical wires electrically connect one or more structures in the housing and the electromagnets.

Hereby, the electromagnets can be electrically controlled by the one or more structures in the housing. It is possible to control the electromagnets from a control unit located in the housing.

The one or more electrical wires may form the connection between the attachment arrangement and the housing.

According to a further embodiment, the magnetic or magnetisable members of the attachment arrangement comprise one or more electromagnets, wherein a battery electrically connected to the electromagnets is arranged in an earmould.

The battery may be positioned in the earmould. This would be the case if the hearing device is an IIC hearing aid, hearing aid CIC or an IC hearing aid. If the hearing device is a BTE hearing aid the battery may be arranged in the housing arranged behind the ear.

According to a further embodiment, the magnetic or magnetisable members of the attachment arrangement and/or of the housing comprises one or more electromagnets each comprising an electromagnet coil arranged around a permanent magnet or another core structure made in a magnetic material with a high magnetic permeability.

Hereby, it is possible to provide one or more efficient and compact electromagnets.

In an embodiment, the hearing device comprises a control unit configured to activate the one or more electromagnets in a manner in which the magnetic field generated by the electromagnets is non-constant and non-zero.

Hereby, it is possible to use the control unit to generate a varying magnetic field.

Furthermore, the hearing device may in one embodiment comprise a control unit configured to activate the electromagnets is in a predefined manner on the basis of signals received by the hearing device or processed by the hearing device.

Hereby, it is possible to use signals received by the hearing device or processed by the hearing device as basis for activating the electromagnets. Accordingly, a user-specific control of the electromagnets can be carried out.

According to an embodiment, the attraction members of the first attachment part are mechanically connected by a connection structure.

Hereby it is possible to provide a simple attachment part in which the distance between the attraction members can be controlled. It is possible to provide a constant distance between the attraction members.

The connection structure may be a part of the first attachment part. The connection structure may be formed as a thin structure forming the first attachment structure. A thin structure (e.g. a foil or thin plate member) is comfortable to wear.

According to a further embodiment, the connection structure may be a flexible structure. Hereby, it is possible to arrange the attraction members in a range of positions relative to each other.

The attraction members of the first attachment part are in one embodiment separate non-connected bodies.

Accordingly, the separate non-connected bodies may at least partly be surrounded by one or more structures.

Hereby, it is possible to attach the separate non-connected bodies in the one or more structures in order to provide a suitable attachment. The attachment may be carried out by integrating the separate non-connected bodies in the one or more structures.

In a further embodiment, the separate non-connected bodies form part of a separate element configured to be detachably attached to the housing or directly on the pinna.

According to a second aspect of the disclosure, a method for producing a hearing device is provided, wherein the distance between the magnetic or magnetisable members of the housing and/or the magnetic or magnetisable members of the attachment arrangement are selected in order to achieve a predefined magnetic attraction force between the magnetic or magnetisable members of the housing and the magnetic or magnetisable members of the attachment arrangement.

Hereby, it is possible to provide a suitable and predefined magnetic attraction force between the magnetic or magnetisable members.

In an embodiment, the method is a method of providing information to a hearing device user wearing a hearing device according to the disclosure, wherein the method comprises the step of providing information to the user by changing the magnetic force between the magnetic or magnetisable members of the housing and the magnetic or magnetisable members of the attachment arrangement.

According to another aspect of the disclosure, the hearing device comprises:

- a receiving unit configured to receive one or more signals/instructions,
- an activation unit configured to alter and/or vary the magnetic field
- generated by the electromagnets and hereby alter and/or changing the magnetic attraction between the attraction members, preferably the magnetic or magnetisable members of the second attachment part and the attraction members of the first attachment part.

Hereby, it is possible to control the magnetic field generated by the electromagnets and hereby regulate the magnetic attraction between the attraction members on the basis of one or more signals or instructions.

According to an even further embodiment, the sensor elements are arranged between the attraction members of either the first attachment part or the second attachment part. Hereby, it is possible to provide a reliable and stable fixation and at the same time provide a compact construction.

According to another embodiment, at least one of said sensor elements comprises a basically plate-shaped contact surface adapted to be brought into contact with the skin of the hearing device user. Hereby, it is possible to provide a contact surface between the sensor elements and the skin of the hearing device user.

According to an even further embodiment, at least one of the sensor elements comprises a basically pointed contact structure adapted to be brought into contact with the skin of the hearing device user. Hereby, it is possible to achieve a high-pressure contact surface between the contact surface between the sensor elements and the skin of the hearing device user.

The hearing device may be of a RITE type hearing aid, where the receiver is arranged in the ear canal of a user, a BTE type hearing aid, an invisible-in-the-canal (IIC) hearing aid or e.g. a completely-in-canal (CIC) hearing aid.

In an embodiment, the sensor elements may be arranged on the second attachment member and configured to be brought into contact with the skin of the ear of the hearing device user. Hereby, it is possible to apply several types of sensor elements arranged on the second attachment member.

Furthermore, in an embodiment the sensor elements may be arranged on the first attachment member, where the first attachment member forms an earmould or a film attached to the pinna on the opposite site of the second attachment member. Hereby, it is possible to provide several popular types of hearing devices provided with sensor elements.

In an embodiment, the housing may be configured with one or more electrodes, arranged on the housing and configured to be brought into contact with the skin of the ear of the hearing device user and wherein one or more electrodes are arranged on the earmould or the attachment arrangement and configured to be brought into contact with the skin of the ear of the hearing device user. Hereby, it is possible to provide a number of popular types of hearing devices provided with sensor elements.

In an embodiment, the sensor elements are electrodes configured to pick up signals from the skin of a user. Hereby, it is possible to detect one or more signals from the skin of the user. The signals may be electrical signals, capacitive measurements, light signals or other suitable signals.

It should be noted that the hearing device is preferably to be construed as a hearing aid.

BRIEF DESCRIPTION OF DRAWINGS

The aspects of the disclosure may be best understood from the following detailed description taken in conjunction with the accompanying figures. The figures are schematic and simplified for clarity, and they just show details to improve the understanding of the claims, while other details are left out. Throughout, the same reference numerals are used for identical or corresponding parts. The individual features of each aspect may each be combined with any or all features of the other aspects. These and other aspects, features and/or technical effect will be apparent from and elucidated with reference to the illustrations described hereinafter in which:

DETAILED DESCRIPTION

Figure 1A:
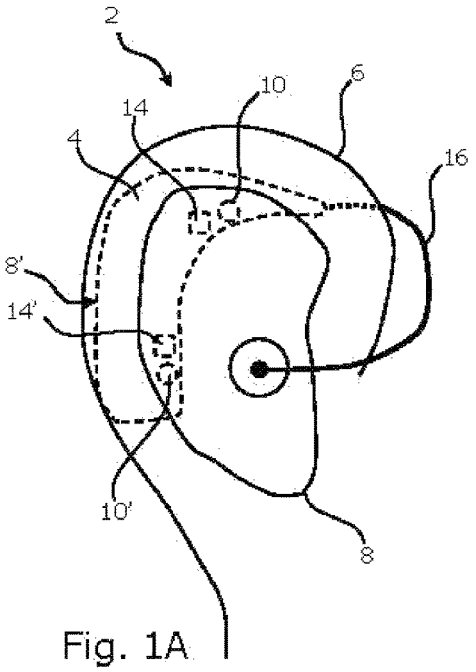
FIG. 1A shows a schematic view of a hearing device according to an embodiment of the disclosure.

The detailed description set forth below in connection with the appended drawings is intended as a description of various configurations. The detailed description includes specific details for the purpose of providing a thorough understanding of various concepts. However, it will be apparent to those skilled in the art that these concepts may be practiced without these specific details. Several aspects of the apparatus and methods are described by various functional units, processes, etc. Depending upon particular application, design constraints or other reasons, these elements may be implemented using electronic hardware, computer program, or any combination thereof.

A hearing device may include a hearing aid that is adapted to improve or augment the hearing capability of a user by receiving an acoustic signal from a user's surroundings, generating a corresponding audio signal, possibly modifying the audio signal and providing the possibly modified audio signal as an audible signal to at least one of the user's ears. The "hearing device" may further refer to a device such as an earphone or a headset adapted to receive an audio signal electronically, possibly modifying the audio signal and providing the possibly modified audio signals as an audible signal to at least one of the user's ears. Such audible signals may be provided in the form of an acoustic signal radiated into the user's outer ear, or an acoustic signal transferred as mechanical vibrations to the user's inner ears through bone structure of the user's head and/or through parts of middle ear of the user or electric signals transferred directly or indirectly to cochlear nerve and/or to auditory cortex of the user.

The hearing device is adapted to be worn in any known way. This may include i) arranging a unit of the hearing device behind the ear with a tube leading air-borne acoustic signals into the ear canal or with a receiver/loudspeaker arranged close to or in the ear canal such as in a Behind-the-Ear type hearing aid, and/or ii) arranging the hearing device entirely or partly in the pinna and/or in the ear canal of the user such as in an In-the-Ear type hearing aid or In-the-Canal/Completely-in-Canal type hearing aid.

A "hearing system" refers to a system comprising one or two hearing devices, and a "binaural hearing system" refers to a system comprising two hearing devices where the devices are adapted to cooperatively provide audible signals to both of the user's ears. The hearing system or binaural hearing system may further include auxiliary device(s) that communicates with at least one hearing device, the auxiliary device affecting the operation of the hearing devices and/or benefitting from the functioning of the hearing devices.

In general, a hearing device includes i) an input unit such as a microphone for receiving an acoustic signal from a user's surroundings and providing a corresponding input audio signal, and/or ii) a receiving unit for electronically receiving an input audio signal. The hearing device further includes a signal processing unit for processing the input audio signal and an output unit for providing an audible signal to the user in dependence on the processed audio signal.

The input unit may include multiple input microphones, e.g. for providing direction-dependent audio signal processing. Such directional microphone system is adapted to enhance a target acoustic source among a multitude of acoustic sources in the user's environment. In one aspect, the directional system is adapted to detect (such as adaptively detect) from which direction a particular part of the microphone signal originates. This may be achieved by using conventionally known methods. The signal processing unit may include amplifier that is adapted to apply a frequency dependent gain to the input audio signal. The signal processing unit may further be adapted to provide other relevant functionality such as compression, noise reduction, etc. The output unit may include an output transducer such as a loudspeaker/receiver for providing an air-borne acoustic signal transcutaneously.

Now referring to FIG. 1A, which illustrates a hearing device 2 according to an embodiment. The hearing device 2 comprises a housing 4 (indicated with a dotted line) arranged behind the outer ear 6 of the user. The hearing device 2 moreover comprises an ear mould (also denoted an earpiece or in the ear part) configured to be arranged in and/or at the ear canal of the user. A sound tube 16 extends from the housing 4 to an ear mold (not shown).

A first attraction member 10 and a second attraction member 10' are provided in connection with the housing 4. Each of the attraction members 10, 10' are arranged to provide an attraction force and hereby attach the housing 4 to corresponding attraction members (not shown) provided at the ear mould. The attraction members 10, 10' may be made in magnetic or magnetisable material (e.g. permanent magnets) or an electrostatic material.

Two sensor elements 14, 14' are provided between the attraction members 10, 10'. The sensor elements 14, 14' may be any suitable type of sensor elements 14, 14', e.g. sensor elements 14, 14' configured to detect electrical conductivity/conductance (e.g. by means of sensor elements 14, 14' formed as electrodes) or transmitted light emitted by one or more light sources (e.g. a light-emitting diode). Furthermore the sensor elements may incorporate transmitting means configured to transmit a signal to e.g. an auxiliary device.

The hearing device 2 comprises a first attachment part 8 is formed by the ear mould and a second attachment part 8' forms an integrated part of the housing 4. The first attachment part 8 and the second attachment part 8' constitute an attachment arrangement configured to maintain the first attachment part 8 and the second attachment part 8' fixed relative to each other on opposite sides of the outer ear 6.

The hearing device 2 may be a BTE hearing aid 2 configured to carry out measurements by the using the sensor elements 14, 14'. The attraction members 10, 10' may e.g. through magnetic coupling with corresponding attraction members (not shown) through the ear flesh be positioned and kept in a fixed position.

Figure 1B:
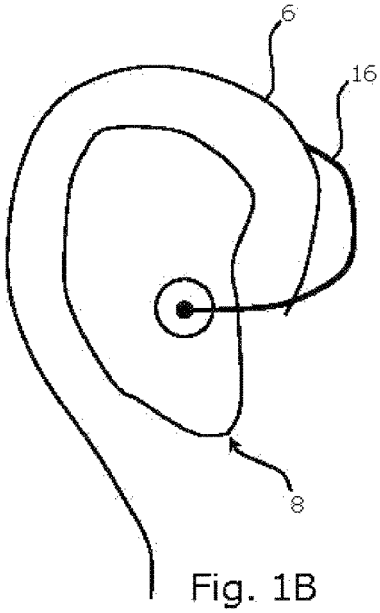
FIG. 1B shows another schematic view of the hearing device shown in FIG. 1A.

FIG. 1B illustrates another schematic view of the hearing device 2 shown in FIG. 1A. The hearing device 2 is seen as it would be seen in reality. Accordingly, the housing (seen in FIG. 1A) is not visible in FIG. 1B. It can be seen that the sound tube 16 is connected to the earmould 8 and that the sound tube 16 extends to the other side of the ear 6.

Figure 2A:
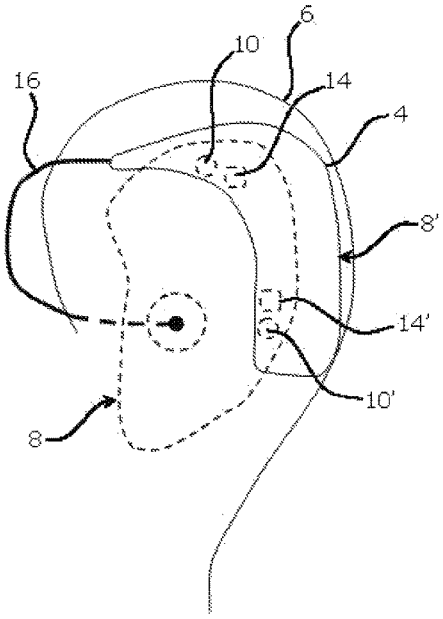
FIG. 2A shows a further schematic view of the hearing device shown in FIG. 1A.

FIG. 2A illustrates a further schematic view of the hearing device 2 shown in FIG. 1A. The hearing device 2 is, however, seen from the opposite side of the outer ear 6. The hearing device 2 comprises the same elements as explained with reference to FIG. 1A. The ear mould comprising the first attachment part 8 is indicated with a dotted line to illustrate that it is arranged on the opposite side of the ear than the housing 4.

Figure 2B:
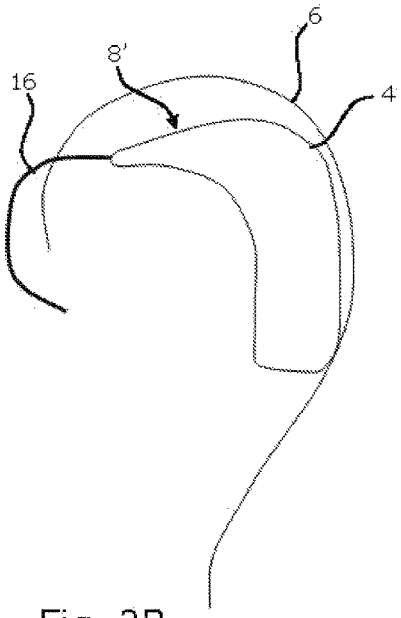
FIG. 2B shows an even further schematic view of the hearing device shown in FIG. 1A.

FIG. 2B illustrates a schematic view of the hearing device shown in FIG. 1A seen from the opposite side of the ear 6.

Figure 3B:
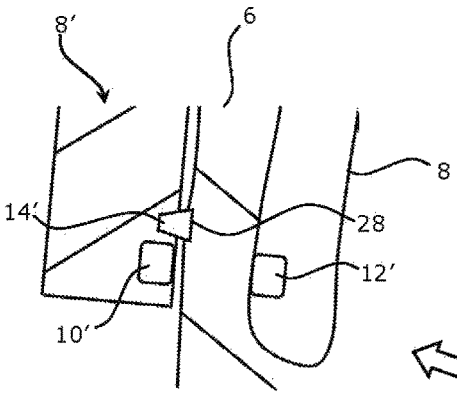
FIG. 3B shows a close-up view of a portion of the hearing device shown in FIG. 3A.
Figure 3A:
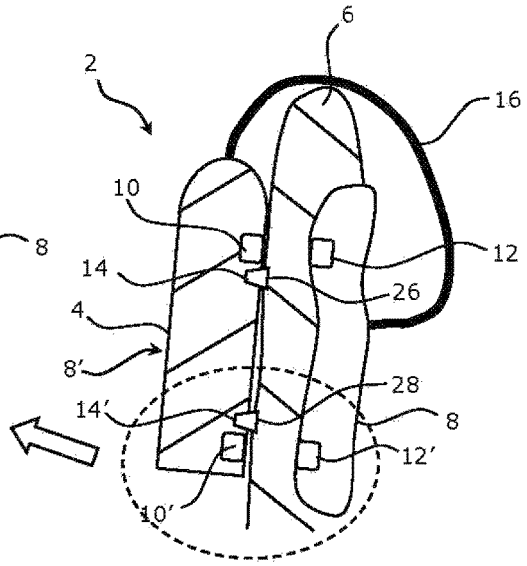
FIG. 3A shows a schematic, cross-sectional view of a hearing device according to an embodiment of the disclosure.

FIG. 3A illustrates a schematic, cross-sectional view of a hearing device 2 according to an embodiment. The hearing device 2 is a BTE hearing aid 2 comprising a housing 4 arranged at a first side of the ear 6 of the user and an ear mould arranged at the opposite side of the ear 6. The earmould constitutes a first attachment part 8, whereas the housing 4 constitutes a second attachment part 8'. The attachment parts 8, 8' are attached to the ear 6 by means of one set of attraction members 10, 10' integrated in the housing 4 and another set of attraction members 12, 12' integrated in the ear mould. The attraction members 10, 10' integrated in the housing 4 and the attraction members 12, 12' integrated in the earmould are opposing each other pairwise. Hereby, the optimum attraction can be achieved by using the attraction members 10, 10', 12, 12'. The attraction members 10, 10', 12, 12' may be made in magnetic or magnetisable material (e.g. permanent magnets) or an electrostatic material.

A sound tube 16 extends from the housing 4 to the earmould. Hereby, sound generated by a receiver (not shown) arranged in the housing 4 can be transmitted into the ear canal of the user through the sound tube 16 and the earmould. It should be noted that the option also exist, that the receiver could be arranged in the ear mold, which would form a receiver in the ear solution.

The housing 4 comprises a first sensor element 14 having a plate-shaped contact surface 26 abutting the ear 6 hereby being in contact with ear 6 on at least skin part thereof. The housing 4 comprises a second sensor element 14' provided with a plate-shaped contact surface 28 abutting the ear 6 on at least a skin part thereof and thus being in contact with ear 6. The sensor elements 14, 14' may be electrodes or other types of sensors configured to detect desirable signals/inputs.

FIG. 3B illustrates a close-up view of a portion of the hearing device 2 shown in FIG. 3A. FIG. 3B illustrates a close-up view of the second sensor element 14'. It can be seen that the second sensor element 14' comprises a plane plate-shaped contact surface 28 that is brought into contact with the ear 6 by the attraction force provided by using the attraction members 10', 12'.

Figure 4:
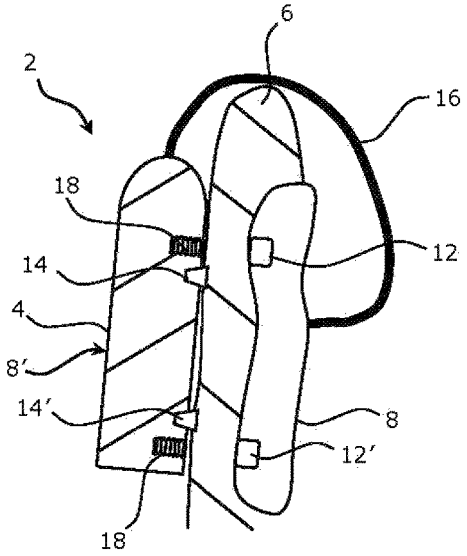
FIG. 4 shows a schematic, cross-sectional view of a hearing device according to another embodiment of the disclosure.

FIG. 4 illustrates a schematic, cross-sectional view of a hearing device 2 according to an embodiment of the disclosure. The hearing device 2 is a BTE hearing aid or could similarly be a receiver in the ear hearing aid 2 provided with a housing 4 positioned at a first side of the ear 6 of the user and an earmould positioned at the opposite side of the ear 6. The earmould forms a first attachment part 8 and the housing 4 forms a second attachment part 8'. The attachment parts 8, 8' are fixedly positioned at each side of the ear 6 by means of one set of attraction members 18, 18' integrated in the housing 4 and another set of attraction members 12, 12' integrated in the ear mould. The attraction members 18, 18' integrated in the housing 4 are formed as electromagnets 18, 18' configured to generate a magnetic field that enables attractive forces between the attraction members 18 and 12 and between the attraction members 18' and 12', respectively. The attachment members 12, 12' integrated in the earmould 8 may be may be made in a magnetic material (e.g. permanent magnets) or in or in a magnetisable material (e.g. iron).

A sound tube 16 connects the housing 4 and the ear mould. Hereby, sound generated by a receiver (not shown) arranged in the housing 4 can be transmitted into the ear canal of the user through the sound tube 16 and the earmould. Alternatively the receiver may be arranged in the ear mold.

The housing 4 comprises a first sensor element 14 provided with a plate-shaped contact surface abutting the ear 6 hereby being in contact with ear 6. The housing 4 furthermore comprises a second sensor element 14' provided with a plate-shaped contact surface abutting the ear 6 and thus being in contact with ear 6. The sensor elements 14, 14' may be electrodes or other types of sensors configured to detect desirable signals/inputs.

Figure 5:
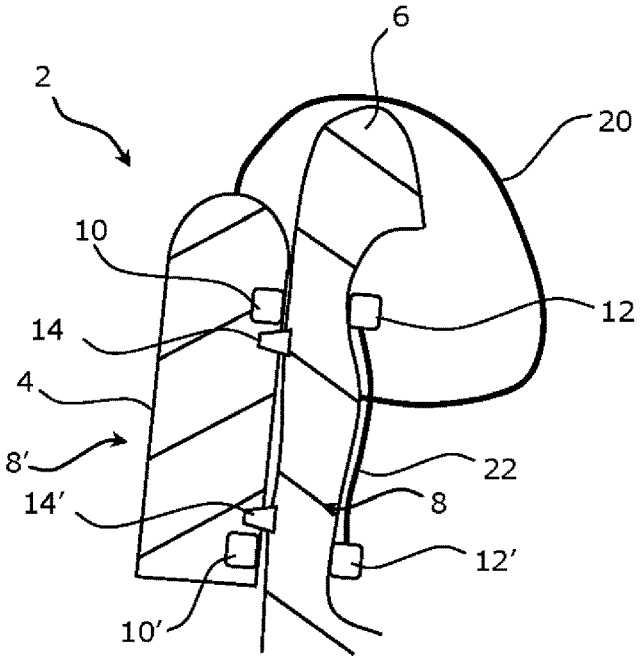
FIG. 5 shows a schematic, cross-sectional view of a hearing device according to an embodiment of the disclosure.

FIG. 5 illustrates a schematic, cross-sectional view of a hearing device 2 according to an embodiment of the disclosure. The hearing device 2 comprises a housing 4 constituting a second attachment part 8' attached to a first side of the ear 6 of the user and a first attachment part 8 attached to the opposite side of the ear 6. The first attachment part 8 comprises a connection structure 22 connected to a first attraction member 12 and a second attraction member 12'. The housing 4 comprises two attraction members 10, 10' arranged and configured to fixedly position the attachment parts 8, 8' at each side of the ear 6 by means of the attraction force provided between the attraction members 10 and 12 and between the attraction members 10' and 12', respectively.

The attraction members 12, 12' may be may be made in a magnetic material (e.g. permanent magnets) or in or in a magnetisable material (e.g. iron).

An electrical cable 20 extends from the housing 4. Hereby, an electrical signal may be transferred through the cable 20 to a receiver (not shown) of a RITE hearing aid.

The housing 4 comprises a first sensor element 14 provided with a plate-shaped contact surface bearing against the ear 6. The housing 4 also comprises a second sensor element 14' provided with a plate-shaped contact surface bearing against the ear 6. The sensor elements 14, 14' may be electrodes or other types of sensors configured to detect desirable signals/inputs.

The first attachment part 8 and the second attachment part 8' are detachably attached to the ear 6.

Figure 6:
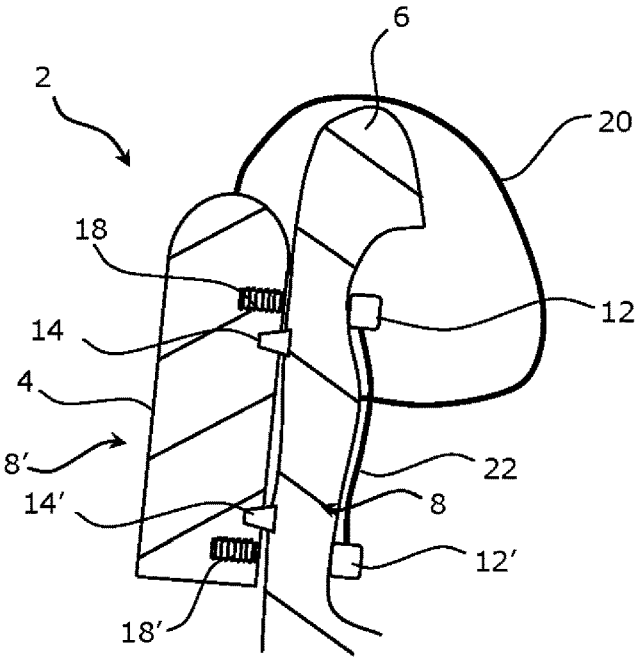
FIG. 6 shows a schematic, cross-sectional view of a hearing device according to another embodiment of the disclosure.

FIG. 6 illustrates a schematic, cross-sectional view of a hearing device 2 according to another embodiment of the disclosure. The hearing device 2 is provided with a housing 4 constituting a second attachment part 8' attached to a first side of the ear 6 of the user and a first attachment part 8 attached to the opposite side of the ear 6. The first attachment part 8 is provided with a connection structure 22 (e.g. a wire) connected to a first attraction member 12 and a second attraction member 12'.

The housing 4 comprises two attraction members 18, 18' each arranged and configured to generate a magnetic field. Hereby, the attachment parts 8, 8' at each side of the ear 6 can be maintained in a fixed position by means of the attraction force provided between the attraction members 10 and 18 and between the attraction members 18' and 12', respectively.

The attraction members 12, 12' may be may be made in a magnetic material (e.g. permanent magnets) or in or in a magnetisable material (e.g. iron). The attraction members 18, 18', however, are electromagnets arranged and configured to be controlled by a control unit (not shown) positioned in the housing 4.

An electrical cable 20 extends between the housing 4 and a receiver (not shown). Accordingly, an electrical signal may be transferred through the cable 20 to the receiver e.g. of a RITE hearing aid.

The first attachment part 8 and the second attachment part 8' are detachably attached to the ear 6.

Figure 7:
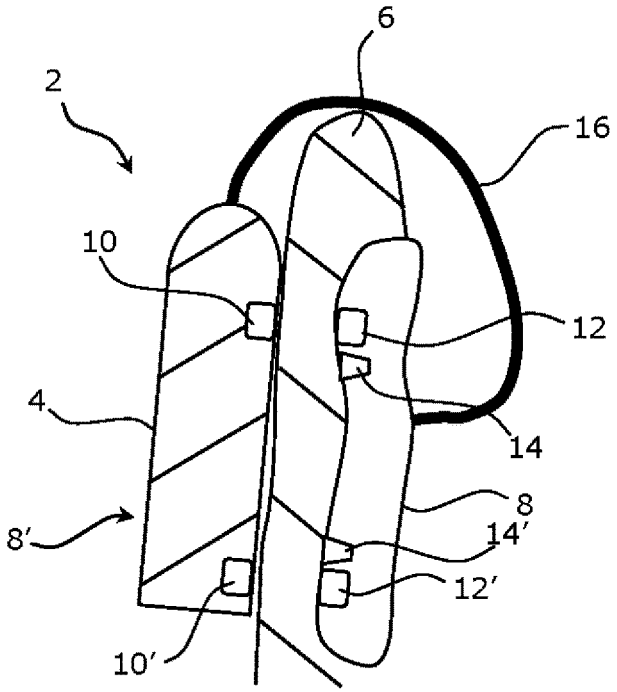
FIG. 7 shows a schematic, cross-sectional view of a hearing device according to an embodiment of the disclosure.

FIG. 7 illustrates a schematic, cross-sectional view of a hearing device 2 according to an embodiment of the disclosure. The hearing device 2 is a BTE hearing aid 2 is provided with a housing 4 arranged at a first side of the ear 6 of the user and an earmould 8 arranged at the opposite side of the ear 6. The earmould 8 forms a first attachment part, whereas the housing 4 forms a second attachment part 8'. The attachment parts 8, 8' are fixed to the ear 6 by means of one set of attraction members 10, 10' integrated in the housing 4 and another set of attraction members 12, 12' integrated in the earmould. The attraction members 10, 10' integrated in the housing 4 and the attraction members 12, 12' integrated in the earmould are opposing each other pairwise. Hereby, the optimum attraction can be achieved by using the attraction members 10, 10', 12, 12'. The attraction members 10, 10', 12, 12' may be may be made in magnetic or magnetisable material (e.g. permanent magnets) or an electrostatic material.

A sound tube 16 extends between housing 4 and the earmould 8. Accordingly, sound generated by a receiver (not shown) arranged in the housing 4 can be transmitted into the ear canal of the user through the sound tube 16 and the earmould 8.

The earmould 8 comprises a first sensor element 14 having a plate-shaped contact surface abutting the ear 6 hereby being in contact with ear 6. The earmould 8 comprises a second sensor element 14' provided with a plate-shaped contact surface abutting the ear 6 and thus being in contact with ear 6. The sensor elements 14, 14' may be electrodes or other types of sensors configured to detect desirable signals/inputs.

Figure 8:
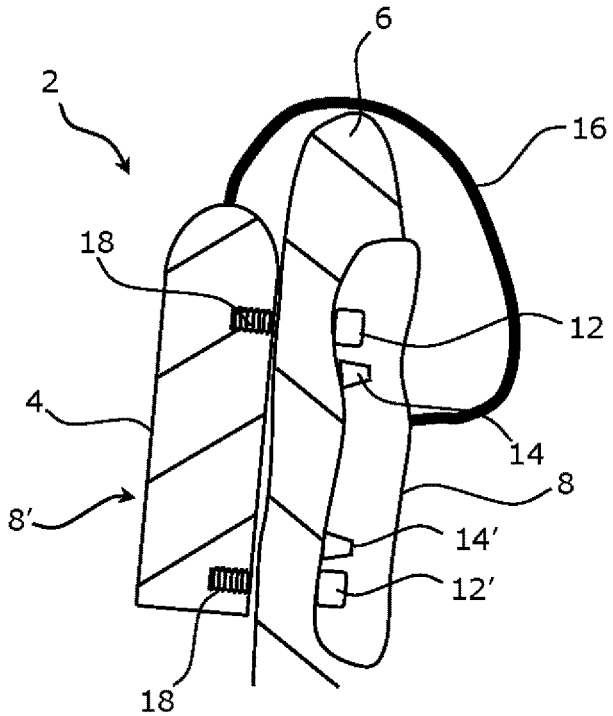
FIG. 8 shows a schematic, cross-sectional view of a hearing device according to another embodiment of the disclosure.

FIG. 8 illustrates a schematic, cross-sectional view of a hearing device 2 according to another embodiment of the disclosure. The hearing device 2 is a BTE hearing aid 2 comprising a housing 4 positioned at a first side of the ear 6 of the user and an earmould 8 positioned at the opposite side of the ear 6. The earmould 8 constitutes a first attachment part and the housing 4 forms a second attachment part 8'. The attachment parts 8, 8' are fixedly arranged at each side of the ear 6 by means of one set of attraction members 18, 18' integrated in the housing 4 and another set of attraction members 12, 12' integrated in the earmould 8. The attraction members 18, 18' integrated in the housing 4 are electromagnets 18, 18' configured to generate a magnetic field that enables attractive forces between the attraction members 18 and 12 and between the attraction members 18' and 12', respectively.

The attachment members 12, 12' integrated in the earmould 8 may be may be made in a magnetic material (e.g. permanent magnets) or in or in a magnetisable material (e.g. iron).

A sound tube 16 connects the housing 4 and the earmould 8. Hereby, sound generated by a receiver (not shown)

arranged in the housing 4 can be transmitted into the ear canal of the user through the sound tube 16 and the earmould 8.

The earmould 8 comprises a first sensor element 14 provided with a plate-shaped contact surface abutting the ear 6 hereby being in contact with ear 6. The earmould 8 moreover comprises a second sensor element 14' provided with a plate-shaped contact surface abutting the ear 6 and thus being in contact with ear 6. The sensor elements 14, 14' may be electrodes or other types of sensors configured to detect desirable signals/inputs.

Figure 9:
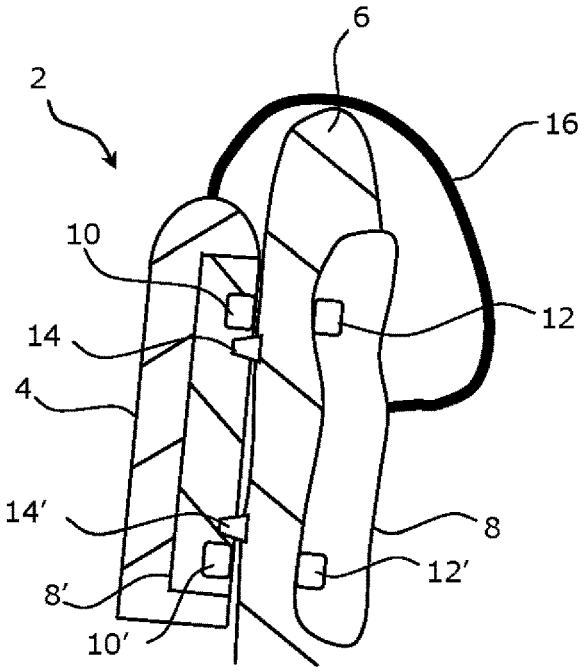
FIG. 9 shows a schematic, cross-sectional view of a hearing device according to an embodiment of the disclosure

FIG. 9 illustrates a schematic, cross-sectional view of a hearing device 2 according to an embodiment of the disclosure. The hearing device 2 is a BTE hearing aid 2 provided with a housing 4 arranged at a first side of the ear 6 of the user and an earmould 8 arranged at the opposite side of the ear 6. The earmould 8 constitutes a first attachment part, whereas the housing 4 comprises a second attachment part 8' provided in the housing 4 as an integrated part.

The attachment parts 8, 8' are attached to the ear 6 by means of one set of attraction members 10, 10' integrated in the housing 4 and another set of attraction members 12, 12' integrated in the earmould 8. The attraction members 10, 10' integrated in the housing 4 and the attraction members 12, 12' integrated in the earmould 8 are opposing each other pairwise. Hereby, it is possible to provide the required attraction between the attraction members 10, 10', 12, 12'. The attraction members 10, 10', 12, 12' may be may be made in magnetic or magnetisable material (e.g. permanent magnets) or an electrostatic material.

A sound tube 16 extends from the housing 4 to the earmould 8. Hereby, sound generated by a receiver (not shown) arranged in the housing 4 can be transmitted into the ear canal of the user through the sound tube 16 and the earmould 8.

The housing 4 comprises a first sensor element 14 having a plate-shaped contact surface abutting the ear 6 hereby being in contact with ear 6. The housing 4 comprises a second sensor element 14' provided with a plate-shaped contact surface abutting the ear 6 and thus being in contact with ear 6. The sensor elements 14, 14' may be electrodes or other types of sensors configured to detect desirable signals/inputs.

Figure 10:
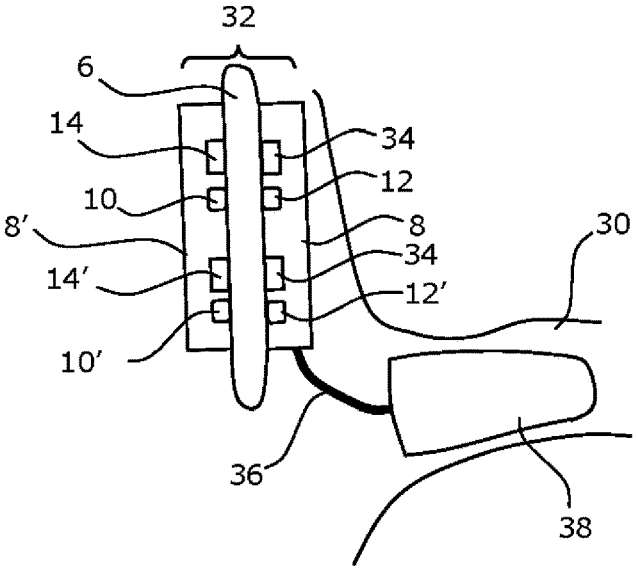
FIG. 10 shows a schematic, cross-sectional view of a hearing device according to another embodiment of the disclosure.

FIG. 10 illustrates a schematic, cross-sectional view of a hearing device 2 according to another embodiment of the disclosure. The hearing device 2 is an ITE hearing aid 2 comprising a housing 38 arranged in the ear canal 30 of the user. An electric wire member 36 extends between the housing 38 and a first attachment part 8 arranged at one side of the outer ear 6 of the user. A second attachment part 8' is arranged at the opposite side of the outer ear 6. The first attachment part 8 and the second attachment part 8' constitute an attachment arrangement 32.

The first attachment part 8 is provided with two attraction members 12, 12' arranged and configured to be attracted by opposing attraction members 10, 10' provided in the second attachment part 8'.

The first attachment part 8 is furthermore provided with sensor elements 34, 34' arranged and configured to interact with corresponding sensor elements 14, 14'. The sensor elements 14, 14', 34, 34' may be formed as transmitter units and receiving units, respectively. Hereby, the sensor elements 14, 14', 34, 34' can be used to transmit light and detect the received fraction of the light.

It should be noted that in view of any of the embodiment described herein it may be that:

The sensor element could form an integrated part of the attraction members.

On or more of the sensor elements are active actuators, e.g. LEDs for shining light through the ear, or for sourcing light to be reflected (perhaps internally) from the ear. Actuators can also be electrodes to electrically stimulate the nerves in the ear.

On or more of the sensor elements pick up light from the skin or transmitted in the ear.

As used, the singular forms "a," "an," and "the" are intended to include the plural forms as well (i.e. to have the meaning "at least one"), unless expressly stated otherwise. It will be further understood that the terms "includes," "comprises," "including," and/or "comprising," when used in this specification, specify the presence of stated features, integers, steps, operations, elements, and/or components, but do not preclude the presence or addition of one or more other features, integers, steps, operations, elements, components, and/or groups thereof. It will also be understood that when an element is referred to as being "connected" or "coupled" to another element, it can be directly connected or coupled to the other element but an intervening elements may also be present, unless expressly stated otherwise. Furthermore, "connected" or "coupled" as used herein may include wirelessly connected or coupled. As used herein, the term "and/or" includes any and all combinations of one or more of the associated listed items. The steps of any disclosed method is not limited to the exact order stated herein, unless expressly stated otherwise.

It should be appreciated that reference throughout this specification to "one embodiment" or "an embodiment" or "an aspect" or features included as "may" means that a particular feature, structure or characteristic described in connection with the embodiment is included in at least one embodiment of the disclosure. Furthermore, the particular features, structures or characteristics may be combined as suitable in one or more embodiments of the disclosure. The previous description is provided to enable any person skilled in the art to practice the various aspects described herein. Various modifications to these aspects will be readily apparent to those skilled in the art, and the generic principles defined herein may be applied to other aspects.

The claims are not intended to be limited to the aspects shown herein, but is to be accorded the full scope consistent with the language of the claims, wherein reference to an element in the singular is not intended to mean "one and only one" unless specifically so stated, but rather "one or more." Unless specifically stated otherwise, the term "some" refers to one or more.

Accordingly, the scope should be judged in terms of the claims that follow.

The invention claimed is:

1. A hearing device comprising a housing configured to be arranged in the ear canal or behind the outer ear of a user, wherein an attachment arrangement is connected to the housing, wherein said attachment arrangement comprises:

at least one first attachment part, and at least one second attachment part, wherein the first attachment part is configured to be arranged at the side of the pinna of a user facing an opening of the ear canal of the user, wherein the second attachment part is configured to be arranged at an opposite side of the pinna than the first attachment part in such a manner that the first attachment part and the second attachment part of the attachment arrangement are fixed relative to each other by means of one or more attraction members provided on each of said first and second attachment parts, wherein the first or second attachment part comprises one or more sensor elements arranged to be brought into contact with a skin portion of the ear of said user by an attraction force provided between the attraction members.

2. Hearing device according to claim 1, wherein the second attachment part is attached to the housing or directly to said pinna of said ear, said second attachment part comprising at least two of said one or more attraction members, and said first attachment part comprises at least two of said one or more attraction members, wherein at least two of the attraction members of the second attachment part are arranged with essentially the same distance to each other as at least two of the attraction members of the first attachment part.

3. Hearing device according to claim 1, wherein the attraction members of the second attachment part are permanent magnets or other ferromagnetic members or said attraction members of the first attachment part are permanent magnets or other ferromagnetic members.

4. Hearing device according to claim 1, wherein the attraction members of the first and second attachment parts being magnetic or magnetisable members of the attachment arrangement comprise one or more electromagnets.

5. Hearing device according to claim 4, wherein the hearing device comprises a control unit configured to activate the one or more electromagnets in a manner in which the magnetic field generated by the electromagnets is non-constant and non-zero.

6. Hearing device according to claim 1, wherein the attraction members of the first attachment part are connected by a connection structure.

7. Hearing device according to claim 1, wherein the attraction members of the first attachment part are separate non-connected bodies.

8. Hearing device according to claim 5, wherein the hearing device comprises:

a receiving unit configured to receive one or more signals/instructions, and an activation unit configured to vary the magnetic field generated by the electromagnets and hereby changing the magnetic attraction between the attraction members, preferably the magnetic or magnetisable members of the second attachment part and the first attachment part.

9. Hearing device according to claim 1, wherein the sensor elements are arranged between the attraction members of either the first attachment part or the second attachment part.

10. Hearing device according to claim 1, wherein at least one of said sensor elements comprises a basically plate-shaped contact surface adapted to be brought into contact with the skin of the hearing device user.

11. Hearing device according to claim 1, wherein at least one of said sensor elements comprises a basically pointed contact structure adapted to be brought into contact with the skin of the hearing device user.

12. Hearing device according to claim 1, wherein said sensor elements are arranged on the second attachment member and configured to be brought into contact with the skin of the ear of the hearing device user.

13. Hearing device according to claim 1, wherein said sensor elements are arranged on said first attachment member, where said first attachment member forms an earmould or a film attached to the pinna on the opposite site of the second attachment member.

14. Hearing device according to claim 1, wherein said sensor elements are electrodes configured to pick up signals from the skin of a user.

15. Hearing device according to claim 1, wherein the hearing device is a hearing aid.

16. Hearing device according to claim 2, wherein the attraction members of the second attachment part are permanent magnets or other ferromagnetic members or said attraction members of the first attachment part are permanent magnets or other ferromagnetic members.

17. Hearing device according to claim 2, wherein the attraction members of the first and second attachment parts being magnetic or magnetisable members of the attachment arrangement comprise one or more electromagnets.

18. Hearing device according to claim 3, wherein the attraction members of the first and second attachment parts being magnetic or magnetisable members of the attachment arrangement comprise one or more electromagnets.

19. Hearing device according to claim 2, wherein the attraction members of the first attachment part are connected by a connection structure.

20. Hearing device according to claim 3, wherein the attraction members of the first attachment part are connected by a connection structure.

* * * * *